US010433640B2

(12) United States Patent
Sanchez Anton

(10) Patent No.: US 10,433,640 B2
(45) Date of Patent: Oct. 8, 2019

(54) MODULAR FURNITURE

(71) Applicant: Jose Maria Sanchez Anton, Logrono la Rioja (ES)

(72) Inventor: Jose Maria Sanchez Anton, Logrono la Rioja (ES)

( * ) Notice: Subject to any disclaimer, the term of this patent is extended or adjusted under 35 U.S.C. 154(b) by 0 days.

(21) Appl. No.: 16/053,255

(22) Filed: Aug. 2, 2018

(65) Prior Publication Data

US 2019/0038020 A1 Feb. 7, 2019

(30) Foreign Application Priority Data

Aug. 3, 2017 (ES) ..... 201730934 U

(51) Int. Cl.

| | |
|---|---|
| ***A47B 47/00*** | (2006.01) |
| ***A47B 96/02*** | (2006.01) |
| ***A47B 47/02*** | (2006.01) |
| ***A47B 47/04*** | (2006.01) |
| ***A47B 57/36*** | (2006.01) |
| *A47B 57/48* | (2006.01) |

(52) U.S. Cl.

CPC ..... *A47B 47/0091* (2013.01); *A47B 47/028* (2013.01); *A47B 47/045* (2013.01); *A47B 57/36* (2013.01); *A47B 96/021* (2013.01); *A47B 57/48* (2013.01)

(58) Field of Classification Search

CPC . A47B 47/028; A47B 47/045; A47B 47/0091; A47B 57/36; A47B 57/48; A47B 96/021

USPC ..... 211/186, 187

See application file for complete search history.

(56) References Cited

U.S. PATENT DOCUMENTS

| | | | | | |
|---|---|---|---|---|---|
| 221,945 | A | * | 11/1879 | Stitzel | A47B 81/007 211/85.22 |
| 366,051 | A | * | 7/1887 | Weatherley | A47B 57/04 108/1 |
| 3,173,385 | A | * | 3/1965 | Tucker | A47B 57/26 108/106 |
| 3,207,322 | A | * | 9/1965 | Pedersen | A47B 57/485 108/106 |
| 3,766,863 | A | * | 10/1973 | Swick, Jr. | A47B 47/021 108/157.13 |

(Continued)

FOREIGN PATENT DOCUMENTS

| | | | | |
|---|---|---|---|---|
| DE | 29719263 U1 | * | 2/1998 | A47B 13/021 |
| FR | 2509593 A1 | | 1/1983 | |

(Continued)

*Primary Examiner* — Stanton L Krycinski

(74) *Attorney, Agent, or Firm* — Lucas & Mercanti, LLP

(57) ABSTRACT

The present invention relates to a piece of modular furniture, comprising a set of elements which can be coupled by fitting to one another, wherein the set of elements comprises at least two pairs of vertical posts, wherein each vertical posts has housings in which conformations of horizontal slats are introduced, and at least one shelf having indentations which can be fitted to the vertical posts, and in that the two vertical posts of each pair reach the end user in a manner in which they are joined to one another by means of the horizontal slats, such that they form a single, ladder-like assembly unit; such that at least one shelf is supported at its ends on the horizontal slats with the vertical posts fitted in the indentations of the shelf, constituting the corresponding furniture just like that.

10 Claims, 7 Drawing Sheets

(56) References Cited

U.S. PATENT DOCUMENTS 3,837,754 A * 9/1974 Malcik ..... A47B 63/00 403/217
3,874,753 A * 4/1975 Naito ..... A47B 47/0041 211/186
3,881,428 A * 5/1975 Klecki ..... A47B 47/03 108/156
4,034,682 A * 7/1977 Bizinover ..... A47B 47/021 108/107
4,099,472 A * 7/1978 Kellogg ..... A47B 87/0246 108/101
D295,705 S * 5/1988 Cornelius ..... D6/675.1
5,022,721 A * 6/1991 Melgers ..... A47B 47/04 108/180
5,054,404 A * 10/1991 Melgers ..... A47B 47/04 108/107
5,411,153 A * 5/1995 Unfried ..... A47B 87/0215 108/180
D377,298 S * 1/1997 Campbell ..... D7/708
5,642,675 A * 7/1997 Webb ..... A47B 5/06 108/42
5,706,741 A * 1/1998 Thorp ..... A47B 47/05 108/153.1
6,152,553 A * 11/2000 Wunderlich ..... A47B 47/0091 108/110
6,378,712 B1 * 4/2002 Sampl ..... A47B 47/04 108/107
6,386,657 B1 * 5/2002 Frifeldt ..... A47B 47/05 108/27
8,016,140 B2 * 9/2011 Hsieh ..... A47B 47/0083 211/187
8,584,873 B2 * 11/2013 Horn ..... A47B 47/0083 211/187
8,733,851 B2 * 5/2014 Lee ..... A47B 47/005 312/108
2001/0009639 A1 * 7/2001 Gunn ..... A47B 57/10 414/286
2004/0173552 A1 * 9/2004 Rowan ..... F16B 12/40 211/189
2007/0062898 A1 * 3/2007 Choi ..... A47B 57/408 211/192
2010/0059468 A1 * 3/2010 Liang ..... A47B 47/045 211/153

FOREIGN PATENT DOCUMENTS

FR 2532402 A1 * 3/1984 ..... A47B 47/045
FR 2666629 A1 * 3/1992 ..... A47B 47/045
FR 2905677 A1 * 3/2008 ..... A47B 47/045
WO 2015047130 A1 4/2015
WO WO-2015047130 A1 * 4/2015 ..... A47B 47/00

* cited by examiner

MODULAR FURNITURE

CROSS REFERENCE TO RELATED APPLICATION

This application claims priority of Spanish Application No. 201730934 filed Aug. 3, 2017, which is included in its entirety.

FIELD OF THE ART

The present invention relates to material storage, proposing a piece of modular furniture intended for being assembled without further coupling of the different elements making up same other than the physical joining thereof. This piece of modular furniture provides excellent fitting and the possibility of being able to be disassembled in a quick and simple manner, in addition to being able to package the different elements making up same in one and the same flat, small-sized packaging.

State of the Art

Furniture such as shelving, tables, or other storage systems existing on the market, at both domestic and industrial levels, must provide sufficient rigidity and strength so as to be able to support the weight of the products arranged thereon. This means that the different elements forming the furniture must be properly joined to one another.

Conventional shelving which uses coupling elements such as screws, nails, pins, or the like for assembling the different elements forming the shelving are known. This shelving provides extremely excellent strength and rigidity, making it a safe solution for product storage.

Nevertheless, this solution entails the use of coupling elements, as well as the use of the necessary tools for applying said coupling elements, making it complicated and time-consuming to assemble and disassemble the shelving.

Often, this conventional shelving generally has a single assembly, so they are subject to a basic factory configuration, without the possibility of varying their height, width, or the height between shelves.

Furthermore, the need to use coupling elements increases the cost of the shelving in terms of its production, transport, and storage.

Shelving formed by a set of elements which can be coupled by fitting to one another, as in the case of patent document PCT WO2015/047130 and patent FR2509593, is also known. However, the known solutions do not assure sufficient strength and rigidity, nor do they provide for a versatile assembly.

On the other hand, in these known solutions the shelving or furniture is made up of many individual parts which make the packaging and the subsequent assembly more difficult.

There is therefore a need to provide a piece of furniture that does not require coupling elements for assembling the different elements making up same, making it easier to assemble and disassemble said set of elements, providing it with versatility, and assuring suitable rigidity and strength for product storage.

Object of the Invention

The invention relates to a piece of furniture of the type comprising a set of elements which can be coupled by fitting to one another, such that it can be readily assembled in the installation site without having to use coupling elements such as screws, nails, or the like, or tools for applying said coupling elements. The invention is preferably applicable to furniture such as shelving or tables.

The modular furniture of the invention comprises:

- at least two pairs of vertical posts, wherein each vertical post has housings for horizontal slats having conformations that are introduced in the housings of the vertical posts, and
- at least one shelf having indentations which can be fitted to the vertical posts.

With the set of elements coupled to one another, each pair of vertical posts is therefore joined, during use, by the horizontal slats, the conformations of each horizontal slat being introduced in the housings of the vertical posts, and the at least one shelf is supported on the horizontal slats with the vertical posts fitted in the indentations of the shelf.

The housings of the vertical posts preferably have a shape complementary to the conformations of the horizontal slats so as to establish press-fitting between both.

The indentations of the shelves preferably also have a shape complementary to the cross-section of the vertical posts so as to establish press-fitting between both.

According to an embodiment of the horizontal slats, each conformation is arranged at one end of the horizontal slats, the conformations having a cross-section that is smaller than the cross-section of the horizontal slats. The conformations therefore establish a stop limiting the insertion of the horizontal slats in the housings of the vertical posts, which serves as a guide to the user when assembling the furniture.

According to another embodiment of the horizontal slats, each conformation is arranged at one end of the horizontal slats, the conformations having a cross-section which is the same as the cross-section of the horizontal slats, such that the horizontal slats have the same cross-section along their entire length. The insertion of the horizontal slats in the housings of the vertical posts can thereby be adjusted and tolerances between the elements of the furniture can therefore be regulated.

According to a preferred embodiment of the invention, the vertical posts of each pair are joined by means of the horizontal slats, such that they form a single unit, the vertical posts and the horizontal slats are therefore supplied in a manner in which they have already been assembled in a single flat packaging of reduced thickness together with the shelves, so the assembly of the furniture is simplified for the user. In this case, to secure the joint, the conformations of the horizontal slats can be joined in the housings of the vertical posts by means of an adhesive or another similar conventional solution.

The housings of the vertical posts have been envisaged to be arranged with a separation of at least 10 cm with respect to one of the ends of each vertical post, such that a separation of the lowermost shelf of the furniture with respect to the floor is established.

According to an embodiment of the shelves, the indentations are arranged at least at the ends of the larger sides of the shelves. The shelves therefore do not protrude outwardly from the sides of the furniture, so the furniture can be arranged such that it is located next to a wall, the securing of the shelves being partly assured by the furniture being supported against the wall.

According to another embodiment of the shelves, the indentations are arranged at each end of the larger sides of the shelves but with a slight separation with respect to each end. The shelves therefore protrude outwardly from the sides of the furniture, assuring the fixing of the shelves in the furniture. The furniture can therefore be arranged with suitable stability without being supported against the wall.

According to a practical preferred embodiment, the vertical posts have a cross-section with an irregular polygonal configuration with four sides, one of the sides having a beveled shape, such that the fixing of the shelves in the vertical posts is even further assured. Specifically, the vertical posts have a cross-section in the shape of a rectangular trapezoid, a "dovetail"-type assembly being established between the vertical posts and the shelves.

A piece of furniture is thereby obtained which, as a result of its constructive and functional features, is preferably applied for its intended function, where said furniture can be stored and transported in the disassembled state and can be readily assembled in the installation site without having to use coupling elements such as screws, nails, or the like. Furthermore, when more than one shelf is used, the modularity thereof allows configuring the furniture with the shelf height distribution that the user requires. The main advantage lies in the fact that as a result of the rigidity of the furniture, it can be installed alone in the center of an establishment, spanning a maximum width and without being supported against side walls, so as to configure low and wide tables or shelving.

According to the preferred embodiment of the modular furniture object of this invention, the vertical posts and the horizontal slats form from the source an assembly unit which will be referred to as side ladder. In this case, the simplest version of the shelving furniture made according to the invention will consist of two side ladders and as many shelves as the shelving has, such that the packaging is very simple given that the shelves are arranged on one and the same plane as the side ladders. The volume occupied is minimum, which improves transport conditions, and furthermore the most outstanding feature lies in the shelving being assembled by the end user given that he/she would only have to arrange the shelf or shelves between the two side ladders and the furniture would be put together just like that.

DETAILED DESCRIPTION OF THE INVENTION

Figure 1:
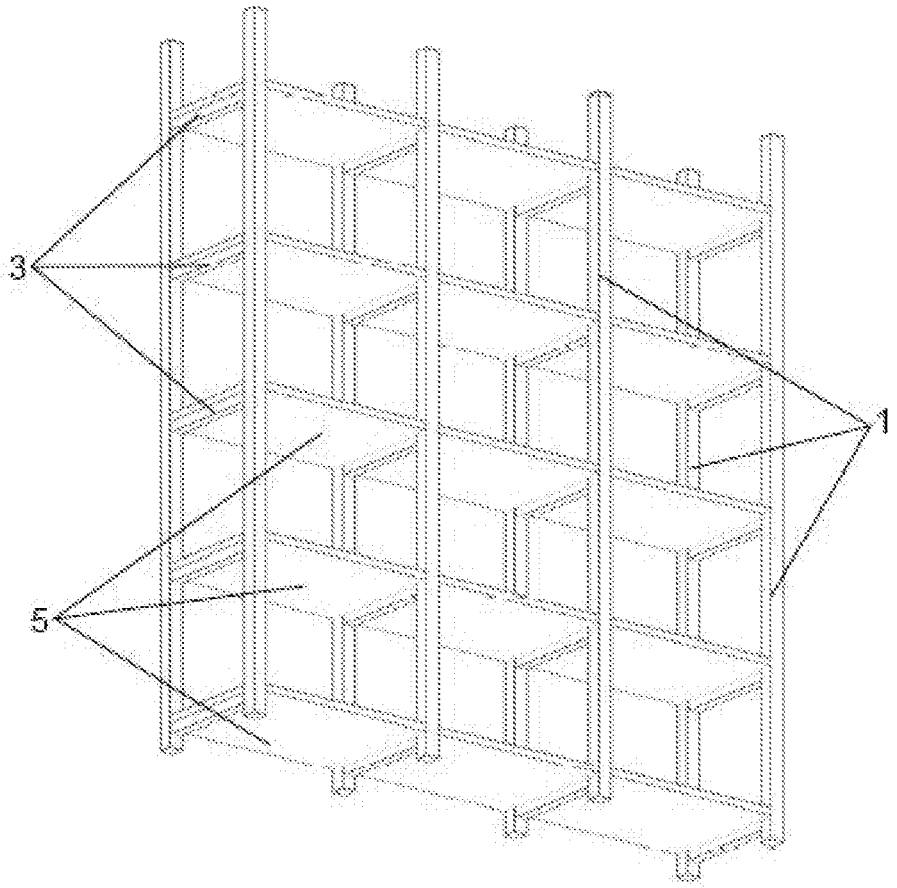
FIG. 1 shows an embodiment of the modular furniture of the invention with its elements coupled to one another, in which the shelves do not protrude laterally from the furniture.

The object of the invention relates to a piece of modular furniture, such as a table or shelving, of the types used for material storage at both domestic and industrial levels, which furniture comprises a set of elements (1, 3, 5) intended for being coupled by fitting to one another, and therefore without having to use coupling elements such as screws, nails, pins, or tools for applying said coupling elements.

The modular furniture comprises at least two pairs of vertical posts (1), wherein each vertical post (1) has housings (2), horizontal slats (3) having conformations (4) configured for being introduced in the housings (2) of the vertical posts (1), and at least one shelf (5) having indentations (6) configured for fitting to the vertical posts (1).

Therefore, when using the furniture, i.e., when the user couples the set of elements (1, 3, 5) making up the furniture to one another, each pair of vertical posts (1) is joined by the horizontal slats (3), and the conformations (4) of each horizontal slat (3) are introduced in the housings (2) of the vertical posts (1), whereas the shelves (5) are supported on the horizontal slats (2) with the vertical posts (1) fitted in the indentations (6) of the shelves (5), a suitable strength and rigidity of the furniture thereby being assured.

When several shelves (5) are used, the furniture corresponds to a shelving such as the one depicted in the drawings, whereas when one shelf (5) is used, the furniture corresponds to a table.

The length, width, and thickness of the vertical posts (1), horizontal slats (3), and shelves (5) are selected depending on the requirements asked of the furniture, such as furniture height, depth, and rigidity.

The elements (1, 3, 5) of the modular furniture are preferably made of wood as it has a good price and appearance, although they may be made of any other material known in the furniture sector, such as metal or plastic.

The housings (2) of the vertical posts (1) have a shape complementary to the conformations (4) of the horizontal slats (3), and the indentations (6) of the shelves (5) have a shape complementary to the cross-section of the vertical posts (1), such that press-fitting is established between said elements. Minimum tolerances between said elements are selected to assure a tight-fitted joining that is, however, sufficient to make it easier to disassemble the furniture.

Figure 5:
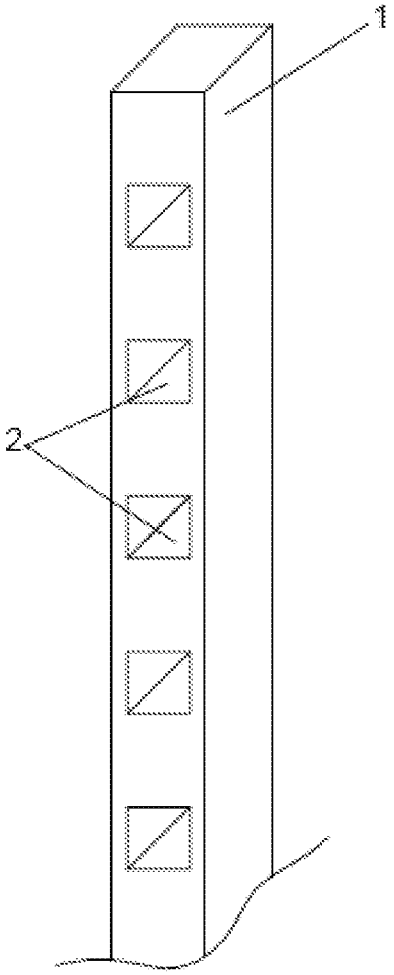
FIG. 5 shows an embodiment of a vertical post with a rectangular cross-section.

As seen in FIG. 5, the vertical slats (1) have a rectangular cross-section with the housings (2) on one of their faces. The housings (2) are separated from one another by a distance according to the required height between shelves (5).

In this type of furniture, it is suitable for the lowermost shelf (5) of the furniture to be separated at least 10 cm from the floor to enable cleaning or to prevent contact with water that may spill under the shelving, so the housings (2) of the vertical posts (1) are preferably arranged with a separation of at least 10 cm with respect to one of the ends of each vertical post (1).

The housings (2) of the vertical posts (1) preferably have a rectangular configuration, although they may have a circular configuration or any other polygonal configuration; in any case, the housings (2) preferably have a shape complementary to the conformations (4) of the horizontal slats (3) to assure a tight-fitted joining.

Figure 6:
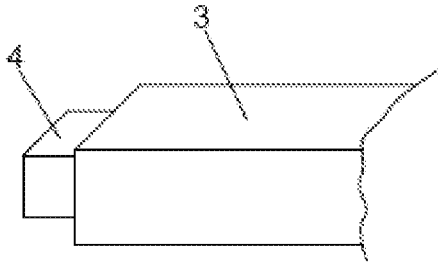
FIG. 6 shows an embodiment of a horizontal slat.

FIG. 6 shows an embodiment of the horizontal slats (3), wherein each conformation (4) is arranged at one end of the horizontal slats (3), and the conformations (4) have a cross-section that is smaller than the cross-section of the horizontal slats (1).

Figure 7:
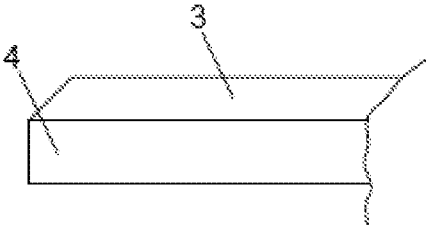
FIG. 7 shows another embodiment of a horizontal slat.

FIG. 7 shows another embodiment of the horizontal slats (3), wherein each conformation (4) is arranged at one end of the horizontal slats (3), the conformations (4) having a cross-section which is the same as the cross-section of the horizontal slats (1), such that the horizontal slats (3) have an identical cross-section along their entire length.

According to one embodiment, the vertical posts (1) of each pair are joined by means of the horizontal slats (3), such that they form a single, side ladder-like assembly unit. According to this embodiment, the conformations (4) of the horizontal slats (3) can possibly be joined to the housings (2) of the vertical posts (1) by means of an adhesive. In any case, by using minimum tolerances a perfect anchoring is achieved and no adhesive is necessary, but in some cases in which tolerances are not suitable, the adhesive can assure the fixing. With these embodiments, the vertical posts (1) are supplied, joined to the horizontal slats (3), in a flat packaging of reduced thickness in which the shelves (5) are also included.

When the vertical posts (1) are joined by the horizontal slats (3), to assure the assembly of the shelves (5), the square or rectangular space formed between said elements (1, 3) must be large enough for a shelf (5) to be introduced therethrough. In other words, the diagonal of the square or rectangular space formed by the vertical posts (1) with the horizontal slats (3) must be greater than the width of the shelf (5), see FIG. 15.

With the embodiment in which the vertical posts (1) are supplied individually without being joined by the horizontal slats (3), the user can arrange the horizontal slats (3) in the housings (2) of the vertical posts (1) as desired, where he or she can therefore choose the height at which the shelves (5) are arranged in the furniture. In any case, all the elements (1, 3, 5) of the modular furniture are supplied individually but included in a flat packaging of reduced thickness.

Figure 4:
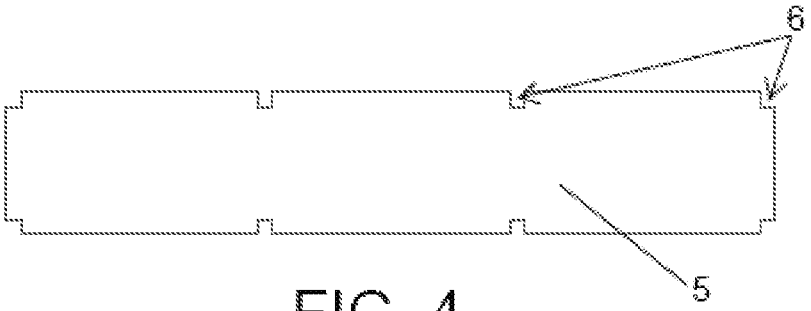
FIG. 4 shows an embodiment of the shelves of the furniture of FIG. 1.

FIG. 1 shows an embodiment of the modular furniture of the invention with shelves (5) such as those depicted in FIG. 4. This embodiment is conceived for positioning the furniture supported against a wall, for which the shelves (5) have indentations (6) arranged equidistant from one another on the larger sides, where the indentations (6) are arranged at least at the ends of the shelves (5). The shelves (5) therefore do not protrude outwardly with respect to the vertical posts (1), the furniture being fitted against the wall where it is arranged and the vertical posts (1) abutting with the wall.

Figure 8:
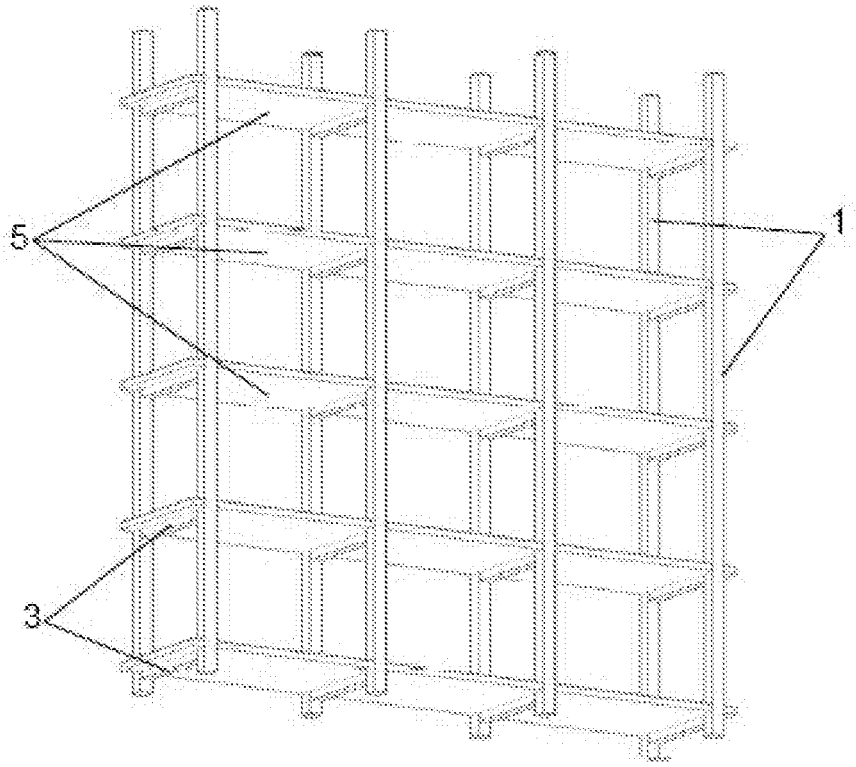
FIG. 8 shows another embodiment of the modular furniture of the invention with its elements coupled to one another, in which the shelves protrude laterally from the furniture.
Figure 9:
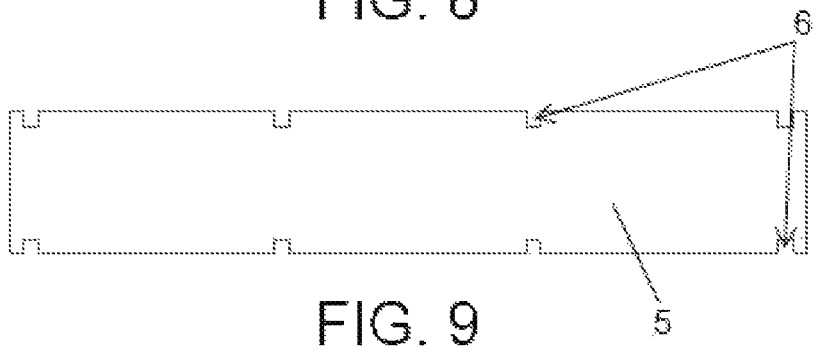
FIG. 9 shows an embodiment of the shelves of the furniture of FIG. 8.

FIG. 8 shows another embodiment of the modular furniture of the invention with shelves (5) such as those depicted in FIG. 9. This embodiment is conceived for positioning the furniture in an intermediate location without being supported against the wall, such that in this embodiment the shelves (5) protrude laterally from the vertical posts (1) to assure a suitable securing of the shelf. (5). To that end, the shelves (5) have indentations (6) arranged equidistant from one another on the larger sides, the indentations (6) being arranged at least at the ends of the shelves (5) but with a slight separation with respect to the ends.

Figure 10:
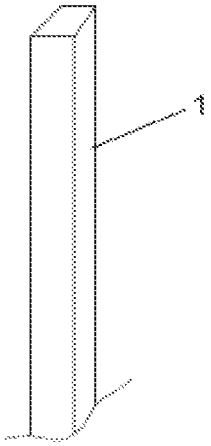
FIG. 10 shows another embodiment of a vertical post with a cross-section with an irregular polygonal configuration (rectangular trapezoid).
Figure 11:
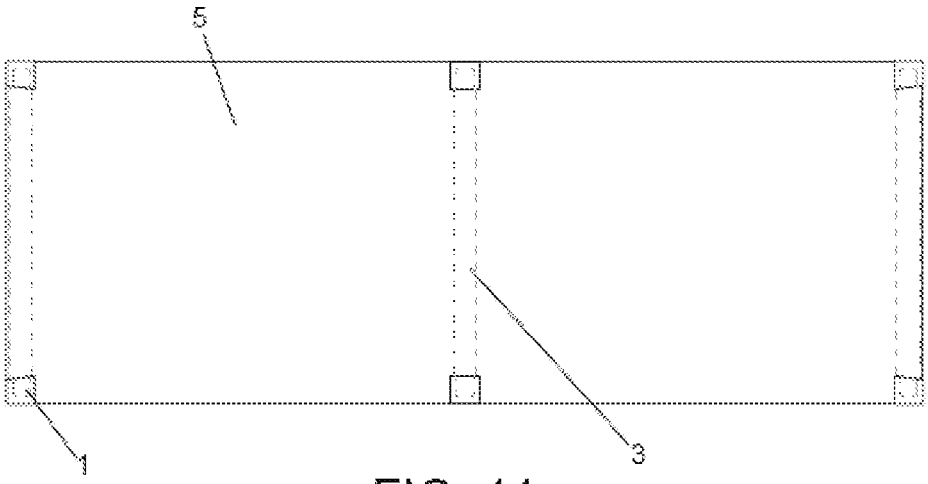
FIG. 11 shows a schematic plan view of a piece of furniture comprising vertical posts such as those depicted in FIG. 10.
Figure 12:
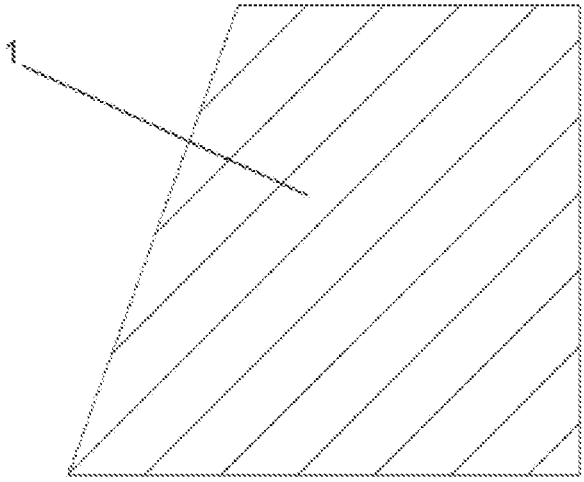
FIG. 12 shows a cross-section of the vertical post depicted in FIG. 10.

FIGS. 1 to 9 show vertical posts (1) with a rectangular cross-section, although they can have another configuration such as a square or another polygonal configuration, such as the irregular polygonal configuration in the shape of a rectangular trapezoid shown in FIGS. 10, 11, and 12, in which the vertical post (1) has a beveled side at least in the area where it fits with the indentations (6), such that with the indentation (6) having a complementary shape, a "dovetail"-type joint is established between the vertical post (1) and the indentation (6) of the shelf (5), assuring complete anchoring.

Each vertical post (1) therefore has four sides, one of them having a beveled shape, such that the beveled side forms an angle with respect to the contiguous side smaller than 90°, and preferably smaller than 80°. The shelf (5) therefore cannot slide horizontally with respect to the vertical post (1), which could indeed happen if the vertical post (1) has a rectangular or square cross-section with angles equal to 90° between its sides.

Figure 13:
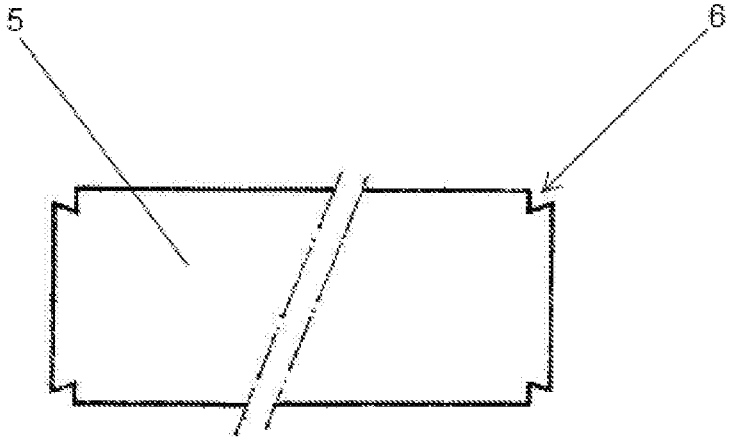
FIG. 13 is a plan view of a shelf.

FIG. 12 shows a cross-section of the version of the vertical posts (1) indicated in the preceding paragraph, i.e., with one of its sides beveled, and FIG. 13 shows a shelf (5) with its indentations (6) in a shape complementary to the shape of the bevel of the vertical posts (1), such that a "dovetail"-type joint is established between the vertical posts (1) and the indentations (6) of the shelves (5).

Figure 2:
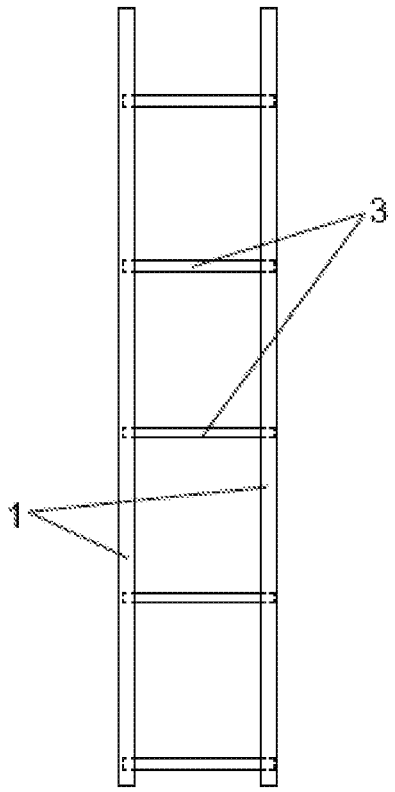
FIGS. 2 and 3 show, respectively, an elevational view and a profile view of the vertical posts joined by the horizontal slats.
Figure 3:
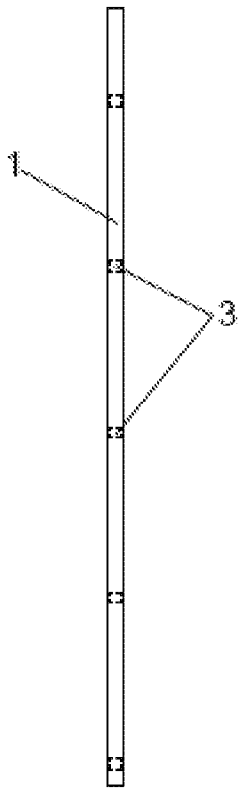

In its simplest version, the furniture shelving would be formed by two ladder-like structures each of which is formed by a pair of vertical posts (1) with their corresponding horizontal slats (3), such as the one depicted in FIGS. 2 and 3, which would be assembled in factory, such that the end user would only have to place the corresponding shelves (5) depicted in FIG. 13 between these two structures and the shelving would be assembled. This embodiment furthermore allows safe transport and occupies minimum space, both from the manufacturing site to the point of sale, and thereafter to the point of installation, given that the two ladder-like structures and the shelves (5) can be arranged such that they occupy parallel planes.

Figure 14:
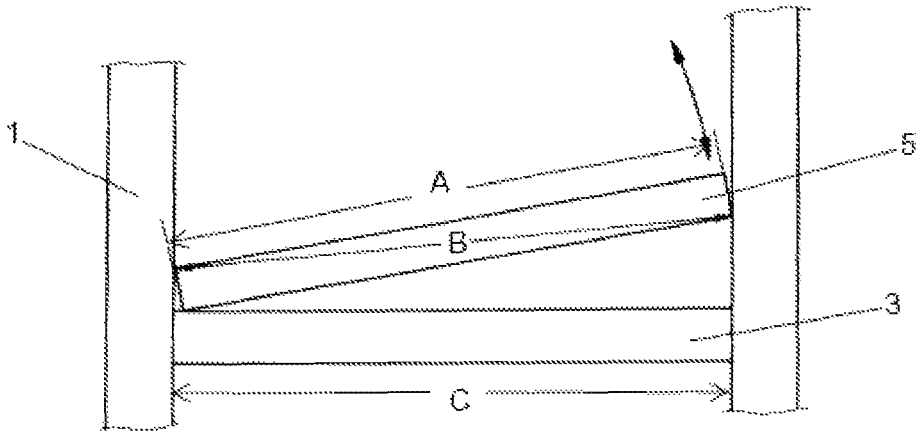
FIGS. 14 and 15 are respective elevational views schematically showing the assembly of the shelves.
Figure 15:
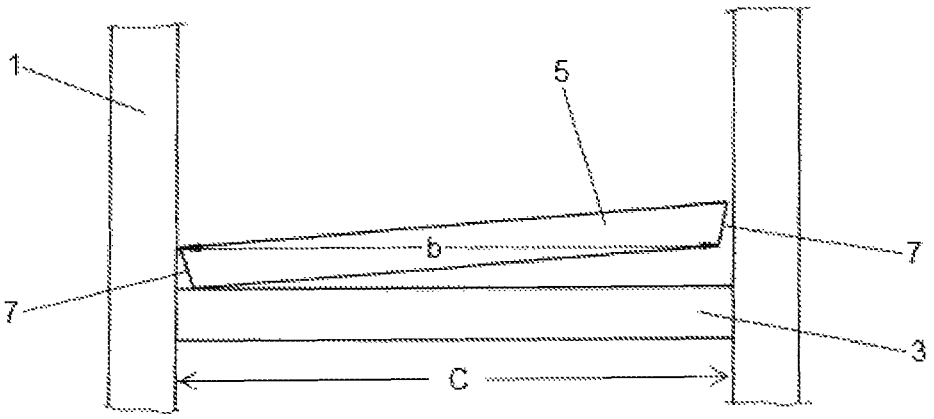

As seen in FIG. 14, if each shelf (5) had the same measurement "A" at the upper edge and the lower edge of the part of that has to be fitted between the vertical posts (1), in this case the diagonal "B" would have a measurement greater than the measurement of the separation "C" between the vertical posts (1), which would result in an interference when assembling the shelf (5). To prevent this interference, chamfering (7) has been envisioned to be made in the respective indentations (6) of the shelf (5), as shown in FIG. 15, such that the measurement of the diagonal "b" is therefore smaller than the measurement of the separation "C" between the vertical posts (1), said interference thereby being prevented.

The invention claimed is:

1. A piece of modular furniture comprising a set of elements which can be coupled by fitting to one another, the piece of modular furniture comprising:

a first plurality of horizontal slats, each horizontal slat comprising a plurality of conformations, each conformation having a first three-dimensional shape having a first side in a first plane, a second side in a second plane different from the first plane, and a third side in a third plane perpendicular to the first and second planes, a plurality of vertical posts, each vertical post comprising a plurality of housings, each housing comprising a cavity having a second three-dimensional shape, the second three-dimensional shape having surfaces corresponding respectively to the first, second, and third sides of the first three-dimensional shape and adapted to receive the first three-dimensional shape, and at least one shelf having a plurality of indentations, each indentation being adapted to receive a respective vertical post, wherein:

a first pair of vertical posts comprising first and second vertical posts selected from among the plurality of vertical posts are parallel and coupled by a second plurality of horizontal slats selected from among the first plurality of horizontal slats, a second pair of vertical posts comprising third and fourth vertical posts selected from among the plurality of vertical posts are parallel and coupled by a third plurality of horizontal slats selected from the first plurality of horizontal slats, and the at least one shelf is disposed on a selected one of the second plurality of horizontal slats and a selected one of the third plurality of horizontal slats, wherein the first, second, third, and fourth vertical posts fit into the plurality of indentations of the at least one shelf.

2. The piece of modular furniture according to claim 1, wherein each of the plurality of indentations of the at least one shelf has a shape complementary to a cross-section of the plurality of vertical posts, wherein a press-fitting is established between the vertical posts and the shelves, wherein each of the plurality of vertical posts has a cross-section with an irregular polygonal configuration with four sides, wherein one of the sides has a beveled shape, wherein a dovetail assembly is established between the vertical posts and the indentations of the shelves.

3. The piece of modular furniture according to claim 1, wherein each of the plurality of housings of the vertical posts has a shape complementary to the conformations of the horizontal slats, wherein a press-fitting is established between a respective conformation and a respective housing when the respective conformation is fitted into the respective housing.

4. The piece of modular furniture according to claim 1, wherein each of the plurality of indentations of the at least one shelf has a shape complementary to a cross-section of the vertical posts, wherein a press-fitting is established between a respective vertical post and a respective indentation when the respective vertical post is fitted into the respective indentation.

5. The piece of modular furniture according to claim 1, wherein each of the plurality of conformations is disposed at a respective end of a respective horizontal slat, and has a first cross-section that is smaller than a second cross-section of the horizontal slats.

6. The piece of modular furniture according to claim 1, wherein each of the plurality of conformations is disposed at a respective end of a respective horizontal slat, and has a first cross-section identical to a second cross-section of the horizontal slats, wherein each respective horizontal slat has a uniform cross-section along an entire length the respective horizontal slat.

7. The piece of modular furniture according to claim 1, wherein the housings of each respective vertical post are arranged with a separation of at least 10 cm from a selected end of the respective vertical post.

8. The piece of modular furniture according to claim 1, wherein first indentations among the plurality of indentations are disposed at a first end of a larger side of the at least one shelf and second indentations among the plurality of indentations are disposed at a second end of the larger side of the at least one shelf.

9. The piece of modular furniture according to claim 1, wherein first indentations among the plurality of indentations are disposed at a predetermined separation from a first end of a larger side of the at least one shelf and second indentations among the plurality of indentations are disposed at the predetermined separation from a second end of the larger side of the at least one shelf.

10. The piece of modular furniture according to claim 1, wherein the at least one shelf includes a plurality of chamfers disposed on selected edges of the at least one shelf, wherein a diagonal distance of a cross-section of the at least one shelf does not exceed a separation distance between a selected pair of vertical posts.

* * * * *